US007025478B1

(12) United States Patent
Reinecke et al.

(10) Patent No.: US 7,025,478 B1
(45) Date of Patent: Apr. 11, 2006

(54) ILLUMINABLE APPARATUS

(76) Inventors: Ronald R. Reinecke, 1335 Nagel Ct., West Chicago, IL (US) 60185; Jayne A. Reinecke, 1335 Nagel Ct., West Chicago, IL (US) 60185

( * ) Notice: Subject to any disclaimer, the term of this patent is extended or adjusted under 35 U.S.C. 154(b) by 0 days.

(21) Appl. No.: 10/803,017

(22) Filed: Mar. 17, 2004

(51) Int. Cl.
*F21V 23/04* (2006.01)

(52) U.S. Cl. ..... 362/392; 362/234; 362/276; 362/802; 362/810; 446/447

(58) Field of Classification Search ..... 446/476–477, 446/484–485; 362/234, 276, 392, 802, 806, 362/808, 810
See application file for complete search history.

(56) References Cited

U.S. PATENT DOCUMENTS 1,484,964 A * 2/1924 Benneville ..... 431/125
3,479,561 A * 11/1969 Janning ..... 315/119
D247,385 S 2/1978 Rideau
4,187,532 A * 2/1980 Naffier ..... 362/186
4,416,075 A 11/1983 Bauer
4,462,066 A * 7/1984 Gibson et al. ..... 362/251
5,174,645 A * 12/1992 Chung ..... 362/86
D342,697 S 12/1993 Delson
5,582,478 A * 12/1996 Ambrosino ..... 362/234
6,170,961 B1 1/2001 Knoch
6,198,229 B1 3/2001 McCloud et al.
2002/0098773 A1 7/2002 Hornsby et al.
2004/0203317 A1* 10/2004 Small ..... 446/476

* cited by examiner

*Primary Examiner*—Alan Cariaso
*Assistant Examiner*—Adam C. Rehm
(74) *Attorney, Agent, or Firm*—John W. Harbst

(57) ABSTRACT

An illuminable apparatus including a thematic structure configured with an operably closed chamber and defining an opening extending between an exterior of the structure and the operably closed chamber. A light source is arranged within the operably closed chamber of the structure, and an electric circuit operably connects the light source to a power source to allow the light source to provide luminescence viewable through the opening in the structure. The electric circuit includes a sensor for sensing motion of air passing through the opening in the structure, and further includes a light source control apparatus connected to the sensor for controlling the luminescence provided by the light source. The light source control apparatus is configured to change the luminescence provided by the light source when the motion of air is sensed through the opening in the structure. A method of operating such an illuminable apparatus to produce controlled levels of illumination is also provided.

20 Claims, 5 Drawing Sheets

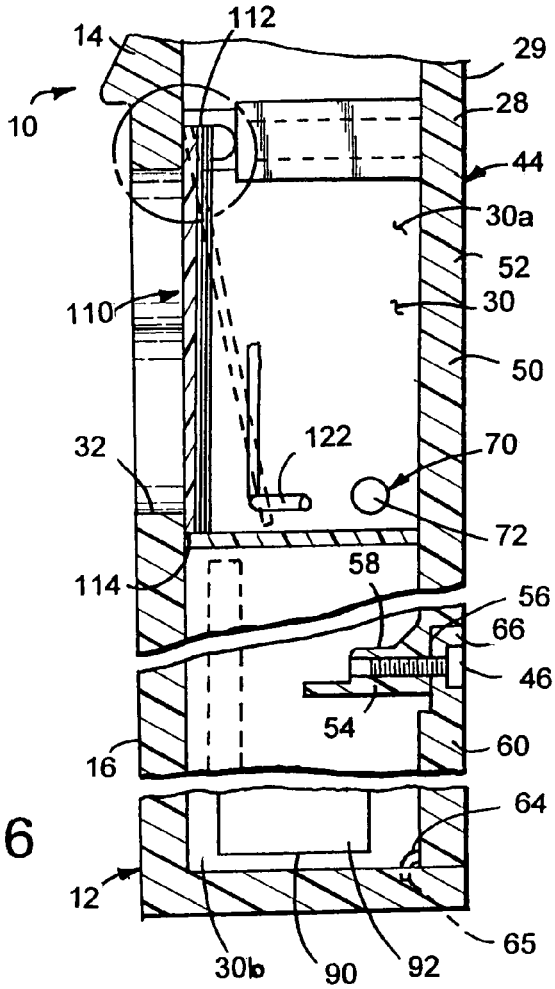
FIG. 6
FIG. 8
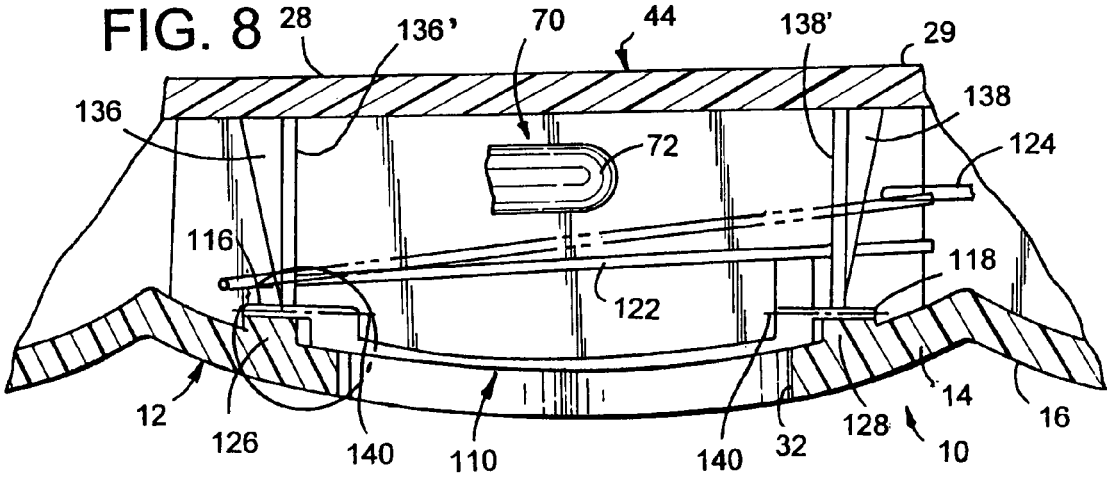

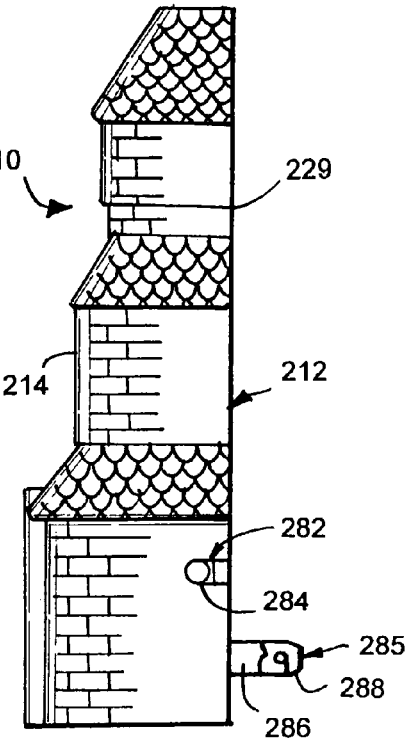
FIG. 11
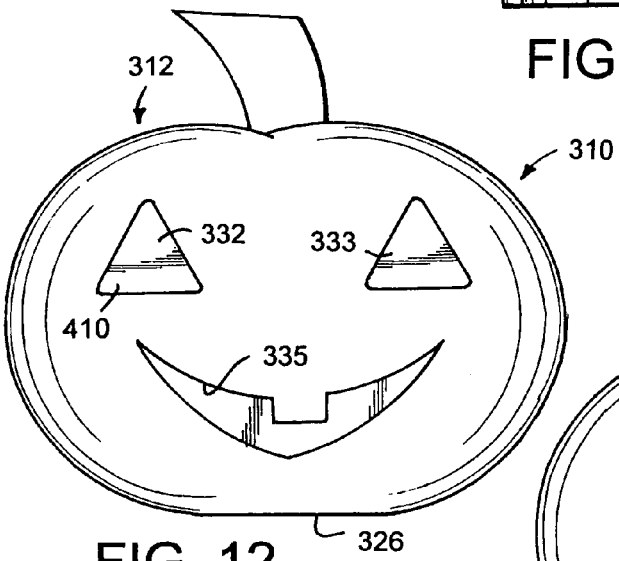
FIG. 12
FIG. 13
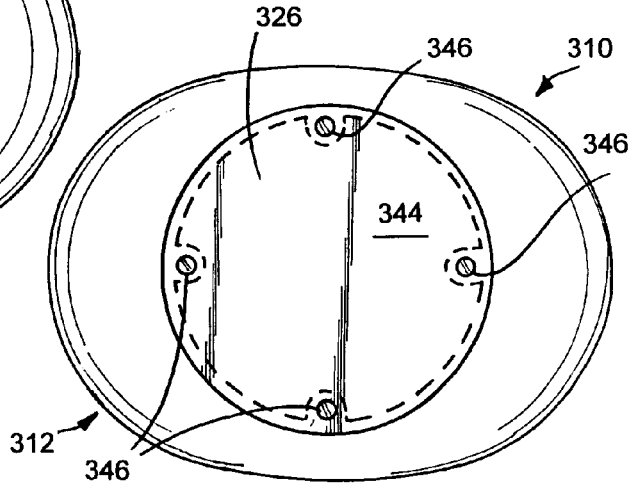

ILLUMINABLE APPARATUS

FIELD OF THE INVENTION

The present invention generally relates to an illuminable apparatus and, more particularly, to an illuminable apparatus having an electrified light source which is selectively operable between at least two different states and a method for controlling illumination of the light source.

BACKGROUND OF THE INVENTION

Children are particularly fascinated with devices requiring their personal interaction. Blowing out candles on a birthday cake is a classic example of how a child's interaction with a particular activity maintains a child's continuing interest in that activity. What would a child's birthday party be without that child's interaction in blowing out the candles on the cake?

Moreover, people of all ages appear to enjoy devices that facilitate their imagination and creativity. Devices which embody certain mystifying characteristics tend to further capture people's attention. Understandably, devices having some mystifying characteristics are particularly fascinating to children. Toys, i.e., houses, castles and the like, having a light source contained therein for producing a luminescence through windows or related openings in the device are known in the art. Some thematic devices attempt to depict environments involving a candle as a form of light source. An electric candle, however, keeps yielding light, when switched on, and does not and cannot imitate the nature of a real candle whose flame will be extinguished when a person blows upon it to extinguish the flame.

Thus, there is a need and continuing desire for an illuminable apparatus having both interactive and imaginative characteristics relating to the operating characteristics thereof.

SUMMARY OF THE INVENTION

In view of the above, and in accordance with one aspect, there is provided an illuminable apparatus including a walled thematic structure configured with an operably closed chamber and defining an opening extending between an exterior of the walled structure and the closed chamber. A light source is arranged within the operably closed chamber of the walled structure. Moreover, an electric circuit operably connects the light source to a power source to allow the light source to yield illumination viewable through the opening in the walled enclosure. The electric circuit includes an apparatus responsive to motion of air passing through the opening in the walled structure whereby causing the light source to cease yielding illumination.

Preferably, a portion of the thematic structure is transparent or translucent so as to allow illumination from the light source to pass therethrough. Additionally, portions of the walled structure are preferably opaque to inhibit illumination from the light source from passing therethrough. In one form, the light source comprises a plurality of lights electrically interconnected relative to each other. In one embodiment, at least one of the plurality of lights is arranged within the operably closed chamber of said walled structure such that the one light is arranged in light transmissive relation relative to the transparent portion of the walled structure.

In one form, the power source for the light in the closed chamber is a battery. In this embodiment, the walled structure includes a removable panel for providing access to an interior of the walled structure. Preferably, the electric circuit includes a manually operated switch for selectively connecting the light source to the power source.

According to another aspect, there is provided an illuminable apparatus including a thematic structure configured with an operably closed chamber and defining an opening extending between an exterior of the structure and the operably closed chamber. A light source is arranged within the operably closed chamber of said structure, and an electric circuit operably connects the light source to a power source to allow the light source to provide luminescence viewable through the opening in the structure or to provide a glowing effect to substantially the entire apparatus. The electric circuit includes a sensor for sensing motion of air passing through the opening in the structure, and further includes a light source control apparatus connected to the sensor for controlling the luminescence provided by the light source. The light source control apparatus is configured to change the luminescence provided by the light source when a motion of air is sensed through the opening in the structure.

In one form, the electric circuit for the apparatus includes a switch for selectively connecting the light source and the power source. Preferably, the light source includes a series of light emitting diodes electrically interconnected relative to each other. Moreover, the power source is preferably a battery arranged within the chamber defined by the structure. A removable panel preferably provides access to the operably closed chamber defined by the structure.

According to another aspect, there is provided an illuminable amusement apparatus including a thematic structure having an operably closed chamber and an opening extending between an exterior of the structure and the closed chamber. A light source is arranged within the operably closed chamber of said structure, and an electric circuit operably connects the light source to a power source to allow the light source to provide luminescence viewable through the opening in the structure. The electric circuit includes a switch for enabling the circuit by connecting the power source and the light source in response to operation of the switch. The electric circuit also includes a sensor for detecting movement of air passing through the opening in the structure. Additionally, the electric circuit includes a control apparatus connected to the sensor for disabling the electric circuit and thereby operably disconnecting the power source from the light source when a motion of air is sensed through the opening in the structure. Furthermore, the electric circuit includes logic circuitry for again enabling the electric circuit through operation of the switch following the motion of air being blown through the opening in the structure.

In one form, the sensor forming part of the electric circuit includes a transparent panel of material mounted within said closed chamber in covering relation relative to the opening. The transparent panel is movable in response to a motion of air passing through the opening in the structure, and with the sensor further including a switch having a contact which is responsive to movement of the transparent panel.

Preferably, the light source comprises a light emitting diode. In one embodiment, the power source for the illuminable amusement apparatus is a battery arranged within the operably closed chamber of the structure for providing a source of energy for said light source. In a preferred form, the structure for the amusement apparatus further includes a removable panel for providing access to the operably closed chamber defined by the structure.

It should be appreciated, the structure of the illuminable apparatus can take a myriad of different shapes and sizes. In one form, illuminable apparatus is configured as a night light for an adult's or child's room. In another form, the structure of the illuminable apparatus is configured as a castle, with the opening in the structure being configured as a window in a castle wall. Alternatively, the illuminated structure can be formed as seasonal ornamentation, such as a pumpkin or the like. As will be appreciated, the structure of the illuminated apparatus can also be formed as a house, car, religious article, i.e, a cross, cake topper, or any other embodiment suitable to maintain an adult's and/or child's interest and enjoyment.

One feature of the present invention relates to the provision of an illuminable apparatus wherein an electrified light source for the apparatus can be mysteriously extinguished by a person blowing through an opening in a wall of the apparatus to simulate extinguishing a candle flame.

Another feature of the present invention relates to the provision of an apparatus which provides luminescence through an opening in the structure of the apparatus and which has a self-contained power source.

Still another feature of the present invention relates to providing an illuminable amusement apparatus which is simple to operate, reliable, economical to manufacture, and which has multifunctional uses throughout and around the home.

Yet another feature of the present invention relates to the provision of an amusement apparatus which provides luminescence through an opening in the structure of the apparatus and which provides a wholly novel manner for controlling the luminescence provided through the opening in the structure of the illuminable amusement apparatus.

These and other features, objects, aims and advantages of the present invention will become more readily apparent from the following detailed description, drawings and the appended claims.

DESCRIPTION OF THE DRAWINGS

FIG. 6 is an enlarged sectional view taken along line 6—6 of FIG. 1;

FIG. 8 is an enlarged sectional view taken along line 8—8 of FIG. 1;

FIG. 11 is a side elevational view of an alternative embodiment of an illuminable apparatus embodying features of the present invention;

FIG. 12 is a front elevational view of another embodiment of an illuminable apparatus embodying features of the present invention; and FIG. 13 is a bottom plan view of that embodiment of the illuminable apparatus illustrated in FIG. 12.

DETAILED DESCRIPTION OF THE INVENTION

Figure 1:
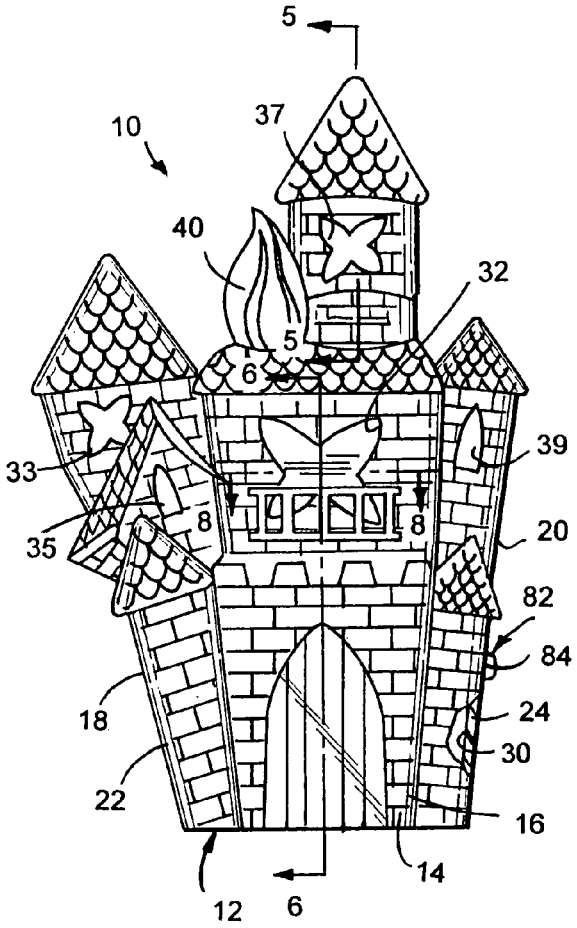
FIG. 1 is a front elevational view of one embodiment of an illuminable apparatus embodying features of the present invention.

While the present invention is susceptible of embodiment in multiple forms, there is shown in the drawings and will hereinafter be described preferred embodiments of the invention, with the understanding the present disclosure sets forth exemplifications of the invention which are not intended to limit the invention to the specific embodiments illustrated and described.

Figure 2:
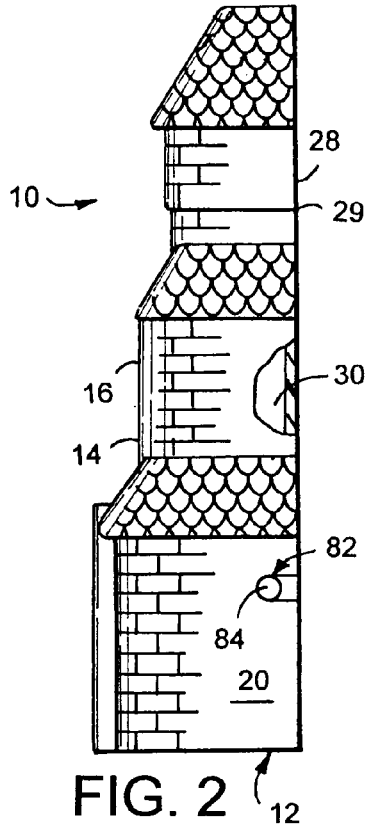
FIG. 2 is a side elevational view of that embodiment of the invention illustrated in FIG. 1.

Referring now to the drawings, wherein like reference numerals indicate like parts through the several views, FIGS. 1 and 2 illustrate one of various embodiments of an illuminable apparatus, generally indicated by reference numeral 10, which embodies principals of the present invention. Apparatus 10 preferably includes a self-supporting housing or structure 12 which, in the exemplary form, is configured as a toy castle or the like. That is, in the form shown, structure 12 has a shape and various decorative elements or accouterments such that it provides an appearance of a medieval type castle. The particular form for the thematic structure selected, however, can vary as it is to be understood the castle theme is for illustrative purposes only. In the form shown in FIGS. 1 and 2, structure 12 has a front surface 14, defined by a front wall 16, and side surfaces 18 and 20, defined by side walls 22 and 24.

Suffice it to say, structure 12 has a hollow configuration defining an operably closed chamber 30. Moreover, structure 12 defines an throughbore or opening 32 extending between an exterior of structure and the operably closed chamber 30. In the example illustrated, and besides opening 32, structure 12 defines a series of openings 33, 35, 37 and 39 which, in keeping with the thematic scheme of the castle, are configured as windows.

In the illustrated embodiment, structure 12 is preferably formed from a plastic, composite, metal, ceramic or alternative suitable material. In one form, and for a majority of the exterior surface area thereof, structure 12 is substantially opaque to control the amount of light emitted from apparatus 10. If and when light transmissive materials are used to form the structure 12, a suitable coating of opaque paint or other suitable covering can preferably be applied to the exterior of the structure to limit the transmission of light from chamber 30 and through the structure 12. Alternatively, the majority of structure 12 can remain translucent and/or transparent such that when apparatus 10 is illuminated the structure 12 will have a "glowing" effect.

Figure 3:
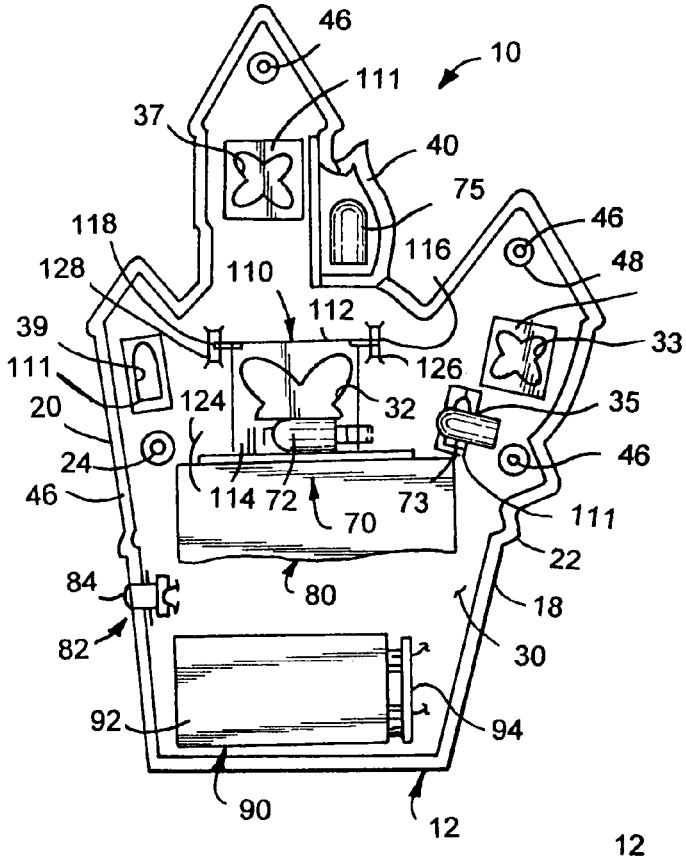
FIG. 3 is a rear elevational view of that embodiment of the invention illustrated in FIG. 1 with parts being removed to allow for illustration of certain details disposed to an interior of the illuminable apparatus.

In another form, a portion of structure 12 can be translucent to allow a controlled amount of electrified light to pass therethrough. In this regard, and as shown in FIGS. 1 and 3, structure 12 is preferably formed with a light transmissive portion 40 which, in the exemplary embodiment, is in the shape of a burning flame extending upwardly from structure 12. Suffice it to say, the light transmissive portion 40 of structure 12 generally compliments the thematic scheme of structure 12 and serves to promote additional illumination to be emitted from apparatus 10.

Figure 4:
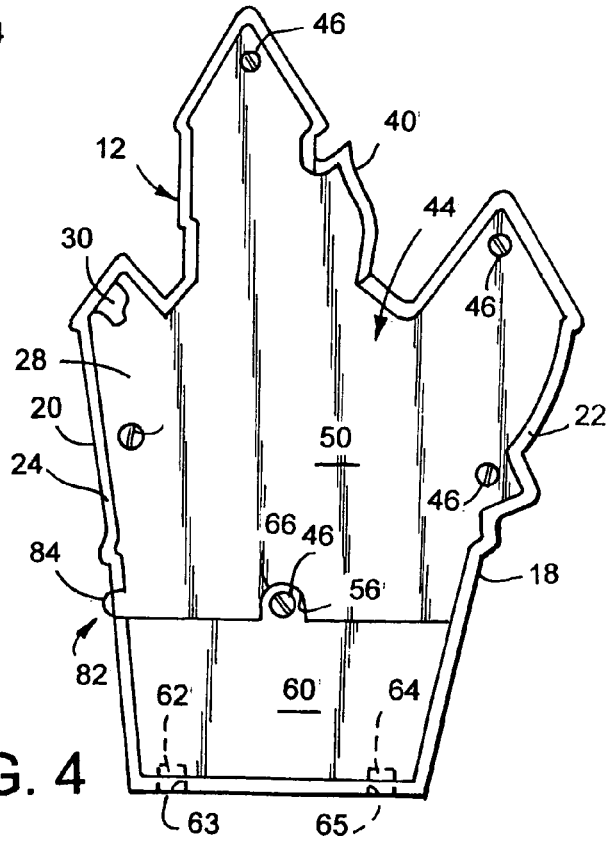
FIG. 4 is a view similar to FIG. 3 but with a cover of the illuminable apparatus being removably secured in place.

Turning to FIG. 4, structure 12 is preferably configured with a removable cover 44 which acts as a back or wall 28 extending across the rear surface 29 of structure 12 and serves to operably close the chamber 30, thus, inhibiting light from escaping from chamber 30. Like structure 12, cover 40 is preferably formed from a molded synthetic resin material, i.e., plastic, a composite, metal, ceramic or alternative suitable material which is substantially opaque. If and when light transmissive materials are used to form cover 44, a suitable coating of opaque paint or other suitable covering can preferably be applied to the exterior of the cover 44 to limit light from escaping the structure 12.

Figure 5:
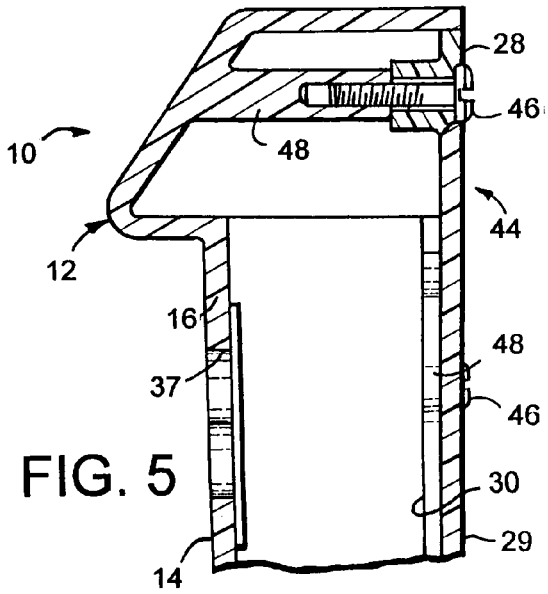
FIG. 5 is an enlarged sectional view taken along line 5—5 of FIG. 1.

In the illustrated embodiment, the cover 44 is releasably secured to the remainder of the structure 12 through use of reusable fasteners 46, such as threaded screws or the like. Preferably, and as shown in FIGS. 3 and 5, structure 12 is integrally formed or provided with a series of projections or bosses 48 which align with the fasteners 46 when cover 44 is to be secured to the structure 12. As such, access to the operably closed chamber 30 is readily and easily accomplished simply by releasing the fasteners 46 and removing the cover 44 from structure 12.

In a preferred embodiment, cover 44 is formed with two panels 50 and 60. As shown in FIG. 6, panel 50 has a generally L-shaped cross-sectional configuration. That is, one portion 52 of panel 50 extends across and operably closes a large portion of the back or rear 28 of structure 12. The other portion 54 of panel 50 extends inwardly and toward the front surface 14 of structure whereby operably dividing the chamber 30 into chambers 30*a* and 30*b*. Toward a lower edge and on an exterior side thereof, panel 50 preferably defines a channel or recess 56 which opens to a lower edge thereof. In the illustrated embodiment, and on an inner side of leg portion 52, rigidly supported by leg portion 54, panel 50 is furthermore preferably provided with an apertured projection 58 formed integral therewith.

The other panel 60 of cover 44 has a generally planar configuration. and In a preferred form, panel 60 operably cooperates with the housing 12 and panel 50 to operably close the remaining portion of the back 28 of structure 12. As shown in FIG. 4, panel 60 is preferably provided with a pair of laterally spaced, aligned and free ended hook-like members 62 and 64 projecting away from and preferably integrally formed with panel 60. The free ends of member 62 and 64 depend downwardly from a lower edge portion of panel 60 and are configured to be releasably accommodated in suitable pockets or detents 63 and 65, respectively defined by a lower wall 26 of structure or housing 12. An apertured ear or tab 66, preferably formed integral with panel 60, and configured to releasably fit within the channel or recess 56 of cover piece 50, projects from an upper edge of the panel 60. As shown in FIGS. 4 and 6, one of the releasable fasteners 46 serve to operably interconnect panels 50, 60 of cover 44.

Returning to FIG. 3, apparatus 10 further includes a light source 70 arranged within chamber 30 defined by structure 12 for providing illumination. The light source 70 can take any of a myriad of different types and sizes such as incandescent, fluorescent, gas discharge, liquid crystal, or solid state without detracting or departing from the spirit and scope of the present invention. In a preferred form, light source 70 includes a light emitting diode 72 preferably arranged in proximate relation to the opening 32 defined by structure 12. In a most preferred embodiment, and besides light 72, the light source 70 includes a plurality of electrified lights 73 and 75 interconnected to each other for emitting light through the openings 33, 35, 37 and 39 defined by structure 12. As shown in FIG. 3, at least one light 75 comprising the light source 70 is preferably disposed in light transmissive relation relative to the translucent portion 40 of structure 12 to promote the transmission of a controlled amount of light from structure 12.

Figure 7:
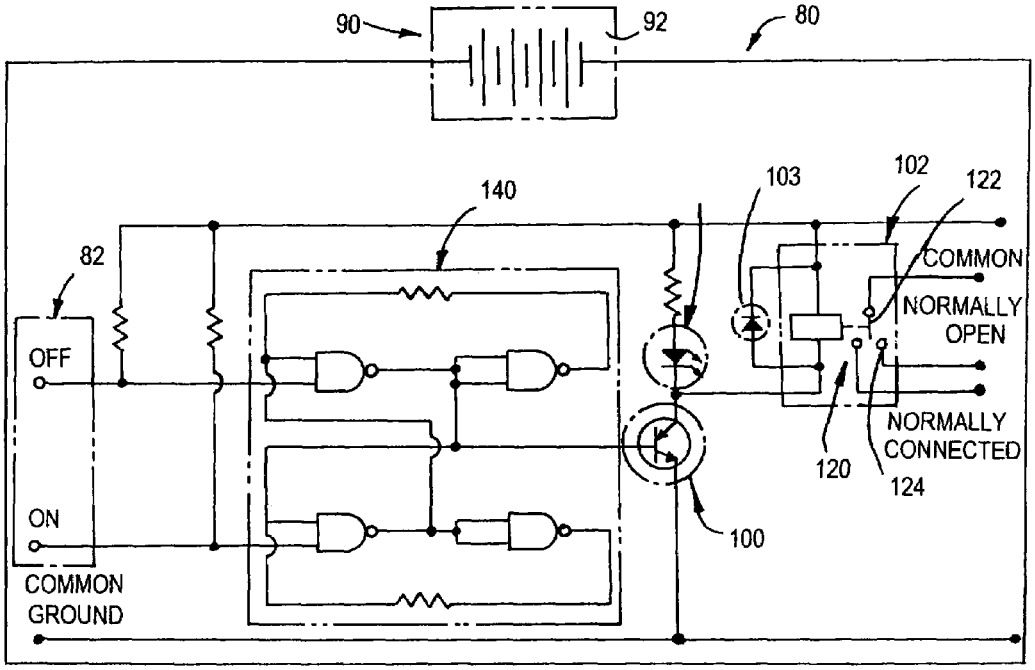
FIG. 7 is schematic diagram of one form of an electric circuit forming part of the present invention.

Turning to FIG. 7, an electric circuit 80 serves to operably interconnect a power source 90 and the light source 70 so as to allow the light source 70 to yield illumination which is viewable through the opening 32 in housing or structure 12 (FIG. 1). In one form, the power source 90 for apparatus 10 comprises a battery 92 whereby advantageously rendering apparatus 10 a self-contained assembly which is suitable for a myriad of different uses. In the embodiment shown in FIG. 6, the battery 92 is preferably arranged and carried within chamber 30*b* of apparatus 10 such that access thereto is readily and easily affected as through panel 60 of cover 44. A battery strap 94 (FIG. 3) electrically interconnects battery 92 to the electric circuit 80 through an ON/OFF switch 82 mounted on the housing or structure 12. As shown, an actuator 84 for the ON/OFF switch 82 (FIGS. 1 through 3) preferably protrudes past the exterior of structure 12 and is suitably disposed for actuation simply by pressing on the actuator 84 which enables the circuit 80, thus, causing the light source 70 to illuminate whereby providing luminescence through the opening 32 and through the translucent portion 40 of the housing or structure 12.

As shown in FIG. 7, one of the many salient features of the present invention relates to configuring electric circuit 80 for apparatus 10 to furthermore include a light source control apparatus 100, which is responsive to motion of air passing through the opening 32 in the housing or structure 12 (FIG. 6) whereby causing the light source 70 to cease yielding illumination. In the illustrated embodiment, the light control apparatus 100 is connected to a sensor 102 forming part of the electric circuit 80. The light source control apparatus 100 in combination with the sensor 102 controls the level of luminescence provided by the light source 70. That is, and after the electric circuit 80 is enabled to illuminate the light source 70, the control apparatus 100 is configured to change the level of luminescence provided by the light source 70 when a motion of air is detected by the sensor 102 through the opening 32 in the housing or structure 12 (FIG. 6). In one form, and after a motion of air is detected by the sensor 102 through the opening 32 in the housing or structure 12, the control apparatus 100 completely disables the circuit 80, thus, inhibiting the light source 70 from emitting any luminescence or light through the opening 32.

In the embodiment shown in FIGS. 3 and 8, a light transmissive panel 110 is mounted on an interior of the housing or structure 12 to cover and extend across an interior side of the housing opening 32. Panel 110 preferably has a profile complimentary to the profile extending across opening 32 and is mounted to move in response to a current or motion of air being blown or otherwise directed through the housing opening 32. As shown, panel 110 depends from an upper edge 112 thereof to allow a lower edge 114 of panel 110 to be displaced or move when a motion of air is directed through the housing opening 32. Preferably, and as shown in FIG. 3, the other openings 33, 35, 37 and 39 in the structure 12 are covered by a light transmissive sheet material 111. In the illustrated embodiment, the light transmissive material 111 extends across the openings 33, 35, 37 and 39 is secured to the interior of the housing or structure 12.

The upper edge 112 of panel 110 preferably includes a pair of axially aligned and laterally spaced pivot pins 116, 118 operably carried by a pair of suitably configured and laterally spaced projections 126, 128, respectively, provided on the interior of housing 12 proximate an upper edge of the housing opening 32. The structure for mounting panel 110 to the housing 12 is substantially similar on opposed sides thereof. As shown in FIG. 8, the pivot pins 116, 118 for the translucent panel 110 are preferably formed integral with the panel 110 and are arranged in combination with respective supports or projections 126, 128 so as to mount the panel 110 for generally arcuate or pivoting movement about a fixed axis 140 and away from the opening 32 when air is blown or otherwise directed through the opening 32 in the housing or structure 12.

When cover 44 is arranged to operably close the chamber 30 in the housing or structure 12 (FIG. 8), a pair of laterally spaced, free ended keepers 136, 138 project from the cover 44 and toward the pivot pins 116, 118, respectively. The keepers 136, 138 are configured such that the free ends thereof generally abut with the pivot pins 116, 118 whereby maintaining the pins 116, 118 in operable combination with the supports or projections 126, 128 mounting the panel 110.

Figure 10:
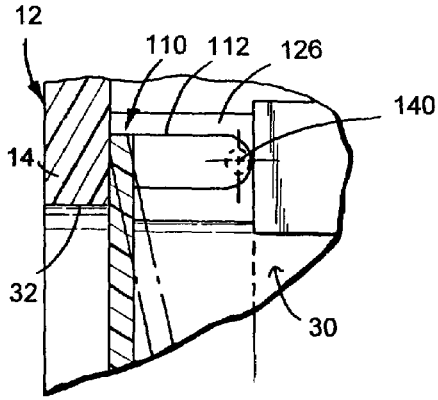
FIG. 10 is a sectional view taken along line 10—10 of FIG. 9.
Figure 9:
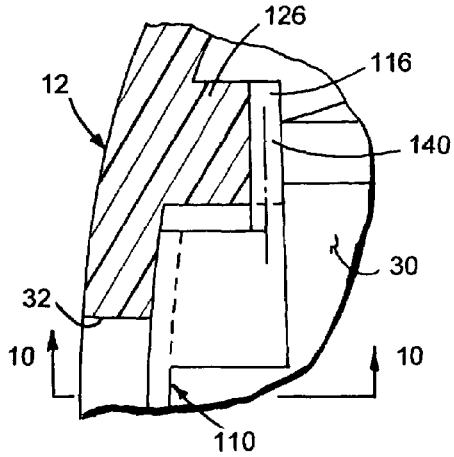
FIG. 9 is an enlarged view of that area encircled in FIG. 8.

Preferably, the keepers 136, 138 are mirror images of each other and thus, a further description of only keeper 136 will be discussed in detail. As shown in FIGS. 9 and 10, each keeper defines a generally planar face 139 disposed to face toward one lateral side of the movable panel 110. As panel 110 moves, in response to a current or motion of air being directed through the opening in the housing 12, the faces 139 on the keepers 136 and 138 guide and inhibits the panel 110 from canting relative to the axis 140, thus, promoting proper operation of the sensor 102. In the illustrated embodiment, and besides facilitating assembly of the apparatus 10, removal of the cover 44 also likewise removes the keepers 136, 138 from their abutting relationship with the pins 116, 118, thereby, allowing panel 110 to be removed or serviced as may be required.

In the exemplary embodiment, sensor 102 of circuit 80 includes a switch 120 for detecting movement of the panel 110. In one form, the sensor switch 120 preferably includes an electrified contact 122 movable along a predetermined path of travel with the panel 110. In a most preferred embodiment, contact 122 is spring biased into operable engagement with the lower edge portion 114 of panel 110. As such, contact 122 causes panel 110 to normally be positioned, as shown in solid lines in FIG. 6, across the housing opening 32 while allowing for ready displacement of the panel 110, as shown in dash lines in FIG. 6, in response to a current or motion of air being blown or otherwise directed through the opening 32 in the structure 12. As should be understood, and in response to movement to a motion or current of air being blown or otherwise directed through the opening 32 in the structure 12, the switch contact 122 moves with panel 110.

As shown in FIGS. 7 and 8, the sensor switch 120 includes another contact 124 arranged generally stationary relative to switch contact 122. In this form, the switch contact 124 is operably arranged in the predetermined path of movement of switch contact 122. As will be appreciated, and like contact 122, the normally open switch contact 124 is electrically connected to the remainder of the electric circuit 80.

Another of the many salient features of the present invention relates to configuring the electric circuit 80 with logic circuitry 140 operably connected to the light control apparatus 100. As will be appreciated by those skilled in the art, the logic circuitry 140 can take any of a myriad of different designs without detracting from the spirit and scope of the present invention. Suffice it to say, the logic circuitry 140 is operably connected to and operable in combination with the ON/OFF switch 82, the light control apparatus 100, and the sensor 102 and, following the light source 70 being controlled to reduce the light emitted thereby as a result of the sensor 102 detecting a motion of air being blow or otherwise directed through the opening 32 in the housing 12, serves the purpose of again enabling the electric circuit 80, through operation of the switch 82, to allow the control apparatus 100 to again return the level of luminescence provided by the light source 70 to a level equal to that level of luminescence provided by the light source 70 before the sensor 102 detected the motion of air being blown or directed through the opening 32.

In the embodiment illustrated in FIG. 7, the electric circuit 80 is furthermore configured to protect the light source 70 and the control apparatus 100 during operation of the electric circuit 80. More specifically, a diode or other suitable apparatus 103 is provided within the circuit 80 for ensuring current flow in a single direction thereby protecting the light source 70 and the control apparatus 100 against two potential current flows.

FIG. 11 illustrated an alternative form for the illuminable apparatus. This alternative embodiment is designated generally by reference numeral 210. Apparatus 210 is structured substantially similar to apparatus 10 and the viewable elements of this alternative illuminable apparatus that are functionally analogous to those components discussed above regarding apparatus 10 are designated by reference numerals identical to those listed above with the exception this embodiment uses reference numerals in the 200 series.

In the form illustrated in FIG. 11, the apparatus 210 is provided with a structure or housing 212 having spaced front and rear surfaces 214 and 229, respectively. Moreover, the illuminable apparatus 210 includes an actuatable ON/OFF switch 282 including an actuator 284 extending beyond the exterior of housing 212 for allowing energization of a light source. In this regard, and like apparatus 10, the illuminable apparatus 210 includes openings (not shown) similar to the openings 32, 33, 35, 37 and 39 on apparatus 10 for allowing light to be emitted from apparatus 210. Additionally, and rather than having a battery for powering a suitable light source, apparatus 210 includes a conventional electrical plug 285 extending from the rear surface or wall 229 of the housing 212. Plug 285 preferably includes two identical electrically conductive leg members 286 and 288 which can be electrically connected to a source of electricity (not shown). As will be appreciated, and due to the alternating current power source, the electric circuit associated with apparatus 210 for accomplishing those same purposes described regarding circuit 80 may require some slight modifications from that illustrated in FIG. 7 but in a manner well known to a person skilled in the art. Accordingly, no detailed description need be provided.

FIGS. 12 and 13 illustrate another alternative form for the illuminable apparatus. This alternative embodiment is designated generally by reference numeral 310. Apparatus 310 is structured substantially similar to apparatus 10 and the viewable elements of this alternative illuminable apparatus that are functionally analogous to those components discussed above regarding apparatus 10 are designated by reference numerals identical to those listed above with the exception this embodiment uses reference numerals in the 300 series.

In the form illustrated in FIGS. 12 and 13, the illuminable apparatus 310 is provided with a structure or housing 312 having a generally round configuration including a generally flat bottom or lower wall 326 to promote support for the apparatus 310. As shown, the structure or housing 312 has a series of openings 332, 333 and 335 defined therein. At least one of those openings is covered on an interior side of the housing 312 by a movable light transmissive panel 410 which is substantially equivalent to panel 110 in structure 10. As shown in FIG. 13, the bottom or lower wall 326 includes a removable cover or plate 344 secured by a series of fasteners 346. As will be appreciated, removal of cover 344 yields access to the interior of the housing 312 and the operable components arranged and carried therewithin.

A brief overview of the operation of the illuminable apparatus 10 will now be provided with the understanding alternative forms of the illuminable apparatus would operate in a substantially similar fashion. The light source 70 for apparatus 10 is easily and readily illuminated by enabling the electric circuit 80 and thereby interconnecting the light source 70 with the power source (which can be the battery 92 or the electrical plug 285). In a preferred embodiment, the electric circuit 80 is enabled through actuation of the ON/OFF switch 82 as by pushing the actuator 84. Upon actuation of the light source 70, a controlled level of light is emitted from the opening 32 in the housing 12 as well as through the transmissive panel 110. In apparatus 10, light from source 70 is likewise emitted through the light transmissive portion 40 of the housing 12. Suffice it to say, the preferable opaqueness of the housing 12, the number and size of the openings 32, 33, 35, 37 and 39, and the configuration of other light transmissive portions, if any, on the housing 12 control and regulate the level of illumination emitted from apparatus 10. As will be appreciated, actuating the switch 82 to illuminate the light source furthermore conditions the logic circuitry 140 of the electric circuit 80 into a first operable state.

Causing a motion of air to be blown or otherwise directed through the opening 32 in the structure 12 will cause the level of illumination provided by the light source 70 to change. In the illustrated embodiment, the electric circuit 80 is configured to control the light source 70 in at least two states or levels of illumination. It is within the spirit and scope of the present invention, however, to configure the electric circuit 80 so as to provide the light source 70 with more than two different levels or states of illumination.

As will be appreciated from the above description, blowing air or causing a motion of air to be directed through the opening 32 in the housing 12 is readily detected by the sensor 102, thus, causing the light source 70 to cease yielding illumination. More specifically, and in the illustrated embodiment, blowing air or causing a motion of air to be directed through the opening 32 causes the panel 110 covering the opening 32 to move, from the solid line position illustrated in FIGS. 6 and 9, toward the dash line position shown in FIGS. 6 and 9. Such movement of the panel 110 is sensed by the contact 122 which moves with the panel 110. Adequate movement of the panel 110 will cause the contacts 122 and 124 to operably engage whereby disabling the light source 70 and, thus, eliminating changing the level of illumination being emitted from the housing 12. Moreover, when the sensor 102 detects a motion or current of air moving or otherwise being directed through the opening 32 in the housing 12, a signal is directed by sensor 102 to the logic circuitry 140, thus, causing circuitry 140 to change state.

In the illustrated embodiment, apparatus 10 will remain in the unlit condition until the switch 82 is again actuated to enable the electric circuit 80, thus, operably connecting the light source 70 to the power source. That is, when the switch 82 is again actuated, the logic circuitry 140 again changes state whereby enabling the circuit 80 to interconnect the light source 70 and the power source 90. As such, the light source 70 is again enabled until another motion or current of air is again blown or otherwise directed through the opening 32 in the housing 12.

As mentioned above, the structure or housing 12 of apparatus 10 illustrated for exemplary purposes happens to be shown as a castle. The principals of the present invention, however, equally apply to any of a multitude of different thematic configurations, i.e., pumpkins, holiday decorations, cars, trucks and related toys. Moreover, it should be appreciated, the light transmissive portion 40 of housing and the light transmissive panel 110 have been generally described as translucent, they may also be formed from colored transparent or related light transmissive materials through which illuminated light will be visible. Furthermore, and while the preferred embodiment is illustrated as being self-supporting, thus, promoting its use as a night light or the like, it should be appreciated the illuminable apparatus can likewise serve as a cake topper or other suitable cake decoration. Of course, use of the battery 92 in combination with apparatus 10 facilitates the stand alone usage of the present invention.

According to still another aspect, there is provided a method of operating the apparatus 10 to produce controlled levels of luminescence. Suffice it to say, such apparatus 10 includes a ousing 12 having an operably closed chamber 30 and defines an opening 32 extending between the chamber 30 and an exterior of the housing 12. One method of operating apparatus 10 comprises the steps of: illuminating an electrified light source 70 within the chamber 30 of the housing 12 in response to actuation of a switch 82 carried by the housing 12; and, controlling the light source 70 to operate at different levels of illumination, with the light source 70 operating at a first level of illumination after the switch 82 is initially operated to connect the light source 70 with a power source 90, and with the light source 70 operating at a second level of illumination after a current of air is blown or otherwise directed through the opening 32 in the housing 12, and wherein circuitry 140 associated with the apparatus 10 returns the light source 70 to the first level of illumination after said current of air has been blown or otherwise directed through the opening 32 in the housing 12 and the switch 82 has again been operated to illuminate the light source 70.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. An illuminable apparatus, comprising:

a walled thematic structure configured with an operably closed chamber and defining an opening extending between an exterior of said walled structure and said closed chamber;

a light source secured within said operably closed chamber of said walled structure;

a light transmissive panel arranged within said closed chamber of said walled structure and, when in a first normal position, extends across so as to cover said opening defined by said walled structure while allowing illumination from said light source in the walled structure to pass therethrough, with said panel being arranged for movement from said first normal position to a second displaced position in response to motion of air passing through the opening in said walled structure; and an electric circuit for operably connecting said light source to a power source to allow said light source to yield illumination viewable through the light transmissive panel and said opening in said walled structure, said electric circuit including an apparatus for turning off power to said light source in response to motion of air passing through the opening in said walled structure, said apparatus including a switch arranged within said closed chamber of said walled enclosure operably between said power source and said light source for turning off power to said light source in response to movement of said light transmissive panel toward said second displaced position.

2. The apparatus according to claim 1, wherein a portion of said walled structure is transparent so as to allow illumination from said light source to pass therethrough, and wherein portions of said walled structure are opaque to inhibit illumination from said light source from passing therethrough.

3. The apparatus according to claim 2, wherein said light source comprises a plurality of lights electrically interconnected relative to each other.

4. The apparatus according to claim 3, wherein at least one said lights of said plurality of lights is arranged within the operably closed chamber of said walled structure such that said at least one light is arranged in light transmissive relation relative to the transparent portion of said walled structure.

5. The apparatus according to claim 1, wherein said power source is a battery for providing a source of energy for said light source.

6. The apparatus according to claim 1, wherein said walled thematic structure includes a removable panel for providing access to an interior of said walled structure.

7. The apparatus according to claim 1, wherein said electric circuit includes a manually operated switch for selectively connecting said light source to said power source.

8. The apparatus according to claim 1, wherein said thematic structure is configured as a castle.

9. An illuminable apparatus, comprising:

a thematic structure configured with an operably closed chamber and defining an opening extending between an exterior of said structure and said operably closed chamber;

a light source secured within said operably closed chamber of said structure;

a light transmissive panel arranged within said closed chamber of said walled structure for movement between a first position, wherein said light transmissive panel extends across and covers the opening defined by said walled structure while allowing illumination from said light source in the walled enclosure to pass therethrough, and a second position with said panel being movable in response to a motion of air being directed through said opening in said walled structure; and an electric circuit for operably connecting said light source to a power source to allow said light source to provide luminescence viewable through the light transmissive panel and said opening in said structure, said electric circuit including a sensor including a switch for detecting movement of said panel between first and second positions, and with said electric circuit further including a light source control apparatus connected to and operable in combination with the switch of said sensor for controlling the luminescence provided by said light source, and with said light source control apparatus being configured to change the luminescence provided by said light source when a motion of air is sensed through said opening in said structure.

10. The apparatus according to claim 9, wherein said light source comprises a series of light emitting diodes electrically interconnected relative to each other.

11. The apparatus according to claim 9, wherein said power source is a battery arranged within said chamber for providing a source of energy for said light source.

12. The apparatus according to claim 9, wherein said structure includes a removable panel for providing access to said operably closed chamber defined by said structure.

13. The apparatus according to claim 9, wherein said electric circuit further includes a manual switch for selectively connecting said light source to said power source.

14. The apparatus according to claim 9, wherein said thematic structure is configured as a castle, and with said opening in said structure being configured as a window in a castle wall.

15. An illuminable amusement apparatus, comprising:

a thematic walled structure configured with an operably closed chamber and defining an opening extending between an exterior of said structure and said closed chamber;

a light source secured within said operably closed chamber of said structure;

a light transmissive panel mounted within said closed chamber of said walled structure for pivotal movement between a first position, wherein said light transmissive panel extends across and covers the opening defined by said walled structure while allowing illumination from said light source in the walled structure to pass therethrough, and a second position, with said panel being pivotally movable in response to a motion of air being directed through said opening in said walled structure; and an electric circuit for operably connecting said light source to a power source to allow said light source to provide luminescence viewable through the light transmissive panel and said opening in said structure, with said electric circuit including a switch for detecting pivotal movement of said panel between said first and second positions and for enabling said circuit by connecting said power source to said light source in response to operation of said switch, and with said electric circuit further including a control apparatus connected to said switch for disabling said electric circuit and thereby operably disconnecting said power source from said light source when a motion of air is sensed through said opening in said structure, and with said electric circuit further including logic circuitry responsive to operation of a manually operated switch for again enabling said electric circuit through operation of said manually operated switch following a motion of air being blown through said opening in said structure.

16. The amusement apparatus according to claim 15, wherein said light source comprises a light emitting diode.

17. The amusement apparatus according to claim 15, wherein said power source is a battery arranged within said chamber for providing a source of energy for said light source.

18. The amusement apparatus according to claim 15, wherein said structure includes a removable panel for providing access to said operably closed chamber defined by said structure.

19. The amusement apparatus according to claim 15, wherein said thematic structure is configured as a castle, and with said opening in said structure being configured as a window in a castle wall.

20. The apparatus according to claim 9, wherein said switch includes a spring biased contact for returning said light transmissive panel to said first position after said motion of air ceases to be directed through the opening in said walled structure.

* * * * *